US008128450B2

(12) United States Patent
Imai

(10) Patent No.: US 8,128,450 B2
(45) Date of Patent: Mar. 6, 2012

(54) THERMOCHROMIC TRANSFORMABLE TOY

(75) Inventor: Jun Imai, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 838 days.

(21) Appl. No.: 11/418,902

(22) Filed: May 4, 2006

(65) Prior Publication Data

US 2007/0259593 A1 Nov. 8, 2007

(51) Int. Cl.

| | |
|---|---|
| ***A63H 3/00*** | (2006.01) |
| ***A63H 9/00*** | (2006.01) |
| ***A63H 17/00*** | (2006.01) |
| ***A63H 33/22*** | (2006.01) |

(52) U.S. Cl. ..... 446/14; 446/321; 446/470

(58) Field of Classification Search ..... 446/14, 446/219, 268, 321, 431, 465, 470

See application file for complete search history.

(56) References Cited

U.S. PATENT DOCUMENTS

| | | | | |
|---|---|---|---|---|
| 1,277,702 | A | | 9/1918 | Des Combes |
| 3,508,344 | A | | 4/1970 | Thomas |
| 3,572,712 | A | | 3/1971 | Vick |
| 4,170,840 | A | | 10/1979 | Ogawa |
| 4,183,173 | A | | 1/1980 | Ogawa |
| 4,206,564 | A | | 6/1980 | Ogawa |
| 4,319,751 | A | | 3/1982 | Kurushima et al. |
| 4,391,060 | A | | 7/1983 | Nakane |
| 4,477,999 | A | | 10/1984 | Harigai et al. |
| 4,487,583 | A | | 12/1984 | Brucker et al. |
| D278,643 | S | | 4/1985 | Ogawa |
| 4,516,948 | A | | 5/1985 | Obara |
| D279,305 | S | | 6/1985 | Murakami |
| D279,306 | S | | 6/1985 | Murakami |
| D279,307 | S | | 6/1985 | Murakami |
| D279,591 | S | | 7/1985 | Ogawa |
| D279,592 | S | | 7/1985 | Ogawa |
| D279,916 | S | | 7/1985 | Obara |
| D281,001 | S | | 10/1985 | Ohno |
| D281,087 | S | | 10/1985 | Ohno |
| D281,088 | S | | 10/1985 | Murakami |
| D281,089 | S | | 10/1985 | Murakami |
| D281,090 | S | | 10/1985 | Murakami |
| 4,554,565 | A | * | 11/1985 | Kito et al. ..... 503/201 |
| 4,569,666 | A | | 2/1986 | Wolf |
| 4,571,201 | A | | 2/1986 | Matsuda |

(Continued)

FOREIGN PATENT DOCUMENTS

CN 2543568 Y 4/2003

(Continued)

OTHER PUBLICATIONS

Notice on the First Office Action dated Jan. 8, 2010 for Chinese Patent Application No. 2007101024484, 11 pages.

(Continued)

*Primary Examiner* — John Ricci

(74) *Attorney, Agent, or Firm* — Edell, Shapiro & Finnan LLC

(57) ABSTRACT

A product, comprising a reconfigurable toy assembly, said assembly being reversibly reconfigurable between at least a first configuration and a second configuration; and the toy including at least one body surface with an integral thermochromic layer covering at least a portion of the body, where the integral thermochromic layer exhibits a visual change in response to temperature is provided.

46 Claims, 12 Drawing Sheets

U.S. PATENT DOCUMENTS 4,571,203 A 2/1986 Murakami
4,575,352 A 3/1986 Matsuda
4,578,046 A 3/1986 Ohno
4,580,993 A 4/1986 Ohno
4,583,957 A 4/1986 Levy
D283,717 S 5/1986 Obara
4,586,911 A 5/1986 Murakami
4,594,071 A 6/1986 Zaruba et al.
4,599,078 A 7/1986 Obara
4,623,317 A 11/1986 Nagano
4,630,756 A 12/1986 Amici et al.
D289,665 S 5/1987 Nagano
D289,908 S 5/1987 Nagano
4,674,985 A * 6/1987 Orenstein et al. ..... 446/14
4,674,990 A 6/1987 Ohno
4,680,018 A 7/1987 Ohno
4,682,969 A 7/1987 Choy et al.
D292,109 S 9/1987 Lim
4,743,030 A 5/1988 Auer et al.
4,750,895 A 6/1988 Shinohara et al.
4,762,511 A * 8/1988 Lee et al. ..... 446/6
4,826,550 A 5/1989 Shimizu et al.
4,854,910 A 8/1989 Yang
4,874,343 A 10/1989 Rosenthal
4,917,643 A 4/1990 Hippely et al.
5,011,445 A 4/1991 Nakasuji et al.
5,052,680 A 10/1991 Malewicki et al.
5,071,387 A 12/1991 Pottick
5,085,607 A * 2/1992 Shibahashi et al. ..... 446/14
5,295,890 A 3/1994 Myers
5,310,379 A 5/1994 Hippely et al.
5,318,202 A 6/1994 D'Andrade
5,375,847 A 12/1994 Fromm et al.
5,411,269 A 5/1995 Thomas
5,474,486 A * 12/1995 Chilton et al. ..... 446/456
5,503,583 A * 4/1996 Hippely et al. ..... 446/14
5,805,245 A 9/1998 Davis
5,823,849 A 10/1998 Gardner et al.
5,826,879 A 10/1998 Spector
5,893,562 A 4/1999 Spector
5,983,544 A 11/1999 Fagan
6,071,166 A 6/2000 Lebensfeld et al.
6,254,486 B1 7/2001 Mathieu et al.
6,345,732 B1 * 2/2002 Zimmerman et al. ..... 222/79
6,346,024 B1 2/2002 Engel
6,412,594 B1 7/2002 Small et al.
6,419,545 B1 * 7/2002 Motosko ..... 446/267
6,468,088 B1 10/2002 Fujita et al.
6,585,555 B2 * 7/2003 Wong et al. ..... 446/153
6,715,763 B2 4/2004 Rudell et al.
6,736,692 B1 5/2004 Hoyos-Zermeno et al.
6,945,782 B2 9/2005 Isoz et al.
6,986,719 B2 1/2006 Kennedy, III
7,037,166 B2 5/2006 Shrock et al.
7,425,169 B2 9/2008 Ganz
7,442,108 B2 10/2008 Ganz
7,465,212 B2 12/2008 Ganz
2002/0127946 A1 9/2002 Hornsby et al.
2002/0132557 A1 9/2002 Yu
2002/0168919 A1 11/2002 Perkins
2003/0077976 A1 4/2003 Wong et al.
2003/0087580 A1 * 5/2003 Shibahashi et al. ..... 446/14
2004/0043806 A1 3/2004 Kirby et al.
2005/0033601 A1 2/2005 Kirby et al.
2005/0059483 A1 3/2005 Borge
2005/0250416 A1 11/2005 Barthold
2005/0287925 A1 12/2005 Proch et al.
2006/0035692 A1 2/2006 Kirby et al.
2006/0166593 A1 7/2006 Shrock et al.
2007/0259592 A1 11/2007 Imai et al.

FOREIGN PATENT DOCUMENTS

FR 2559072 A1 8/1985
GB 2135591 A 9/1984
GB 2151149 A 7/1985
GB 2155346 A 9/1985
GB 2156698 A 10/1985
GB 2184664 A 7/1987
JP 07059952 A 3/1995

OTHER PUBLICATIONS

Written Opinion and Search Report dated Feb. 24, 2010 for French Patent Application No. 0754891, 8 pages.

* cited by examiner

THERMOCHROMIC TRANSFORMABLE TOY

BACKGROUND AND SUMMARY

Various types of toys have incorporated a transformation play element. One example is Transformers, which may be reversibly reconfigured between a vehicle mode and a robot mode. In some example Transformers, a thermochromic sticker was applied to a surface of the toy, where when rubbed with a user's finger, it revealed whether the toy was genuine.

The inventors herein have recognized that improved transformable toys having thermochromic elements may be used to provide increased play value in various respects. For example, toys may be provided in which users can experience both offensive and defensive posturing using exchanged mediums between the toys that interact with thermochromic regions. As another example, an improved visual experience may be achieved by integrating thermochromic regions into the toy. Of course, various other modifications and improvements are also possible, as described in detail herein.

DETAILED DESCRIPTION

Figure 1:
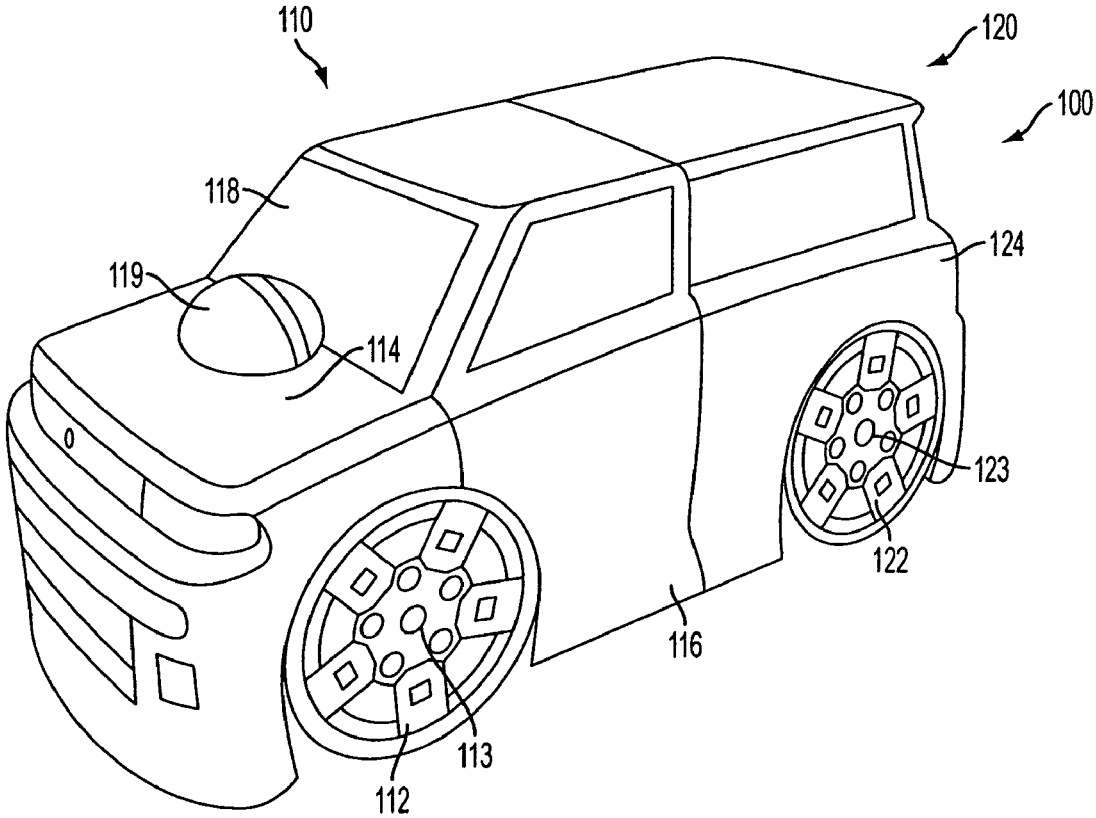
FIGS. 1-5 show a first example toy, which is transformable between a vehicle mode and an action figure mode.

In one example, a set of interrelated toys and accessories may be provided as part of a particular theme, which may include, for example, speed/racing, street culture, transformation, and/or toy conflict. Some toys may include one or more thermochromic regions, which can change appearance responsive to temperature. These thermochromic regions can be configured to provide a variety of patterns, designs, and/or hidden codes such as, for example, simulated blast damage, blast patterns, marks, splotches, blemishes, symbols, etc. Further, these toys may include accessories that can dispense or eject a liquid such as water, wherein the toy may provide feedback to a user via a thermochromic change indicating where the liquid has hit the toy. In this manner, toy interaction may be improved.

In some examples, toys having thermochromic regions and/or liquid dispensing accessories may be reconfigured or transformed between two or more different play configurations. For example, a toy may be transformed between a vehicle mode and an action figure mode simulating for example a robot or other character. Various forms of vehicles may be used, such as cars, trucks, sport utility vehicles, sports cars, motorcycles, planes, boats, submarines, spaceships, rockets, among others. Further, a transformable toy may be configured to interact with a related accessory via a thermochromic change during only one mode or during both modes, for example.

In some examples, some or all of the transformable toys of an interrelated set may share a common transformation framework. The various components that differentiate one toy from another toy of a related toy set may be based on this common transformation framework so that each toy is visually unique, yet transforms in the substantially the same manner as the other toys of the set. In this way, a child may learn how to transform all toys in a set by learning how to transform any toy in the set.

Further, some toys can be provided as part of a particular theme and/or lifestyle. For example, one or more toys and/or related accessories may embody a street culture theme that includes the use and appearance of flashy or excessive components otherwise known as "bling". For example, an action figure or robot toy may include teeth simulating the appearance of gold or jewels such as diamonds, and may include additional extravagance including clothing and accessories such as hats, sports jerseys, shoes, sunglasses, baggy pants, and/or jewelry. Further, the action figure toy may be posed in various body positions simulating attitude or emotion. In another example, a toy vehicle may include various high performance components such as oversized rims, low profile tires, large engine components that project through the hood of the vehicle, tinted windows, lowered chassis, and may include various aesthetic items such as simulated graffiti, chrome components, related advertisements, insignia, or other recognizable symbols. Further, these toys and/or portions thereof may include officially licensed products and/or designs that are physical and/or superficial. For example, a toy vehicle may be designed to simulate a presently popular vehicle, or an action figure toy may include various visually recognizable products such as clothing or shoes from a popular or well known manufacturer.

Several example toys are described herein, which may include one or more of the properties described above, such as transformation, thermochromic behavior, theme based play and appearance, related accessories, and/or a common transformation framework, among others. Specifically, FIGS. 1-5 show a toy 100 that can be reversibly reconfigured or transformed between a vehicle mode and an action figure mode simulating a robot portions of which may include various thermochromic regions. However, it should be appreciated that the thermochromic features described herein may also be applicable to toys not having a transformation capability such as, for example, toy vehicles, action figures, dolls, robots, etc. FIG. 1 shows toy 100 in a vehicle mode. Toy 100 can include a front portion 110 and a rear portion 120 moveably coupled to the front portion. Front portion 110 may include a left and right pair of front wheels 112 (only the left wheel is shown in FIG. 1), front hood 114, left and right front doors 116 (only the left front door is shown in FIG. 1), and front window portion 118. Front wheels 112 may be moveably coupled to toy 100, for example, by a front axle 113 enabling rotation of the front wheels relative to toy 100. Further, front hood 114 may include element 119 that can simulate an engine portion or other vehicle feature. Rear portion 120 may include a left and right pair of rear wheels 122 (only the left wheel is shown in FIG. 1), and rear section 124. Rear wheels 122 may be moveably coupled to toy 100, for example, by a rear axle 123 enabling rotation of the wheel relative to toy 100.

Toy 100 in a vehicle mode may embody a street culture or street racing theme. For example, portions of toy 100 such as front and rear wheels 112 and 122, and engine 119 may be relatively large and may be configured to simulate chrome or shiny metal. Wheels 112 and 122 may be surrounded by tires having a substantially low profile, as shown in FIG. 1. Portions of toy 100 may include various visual markings or designs such as simulated graffiti, advertisements, insignia, and symbols indicating the vehicle manufacturer and/or type of vehicle. Toy 100 may include one or more thermochromic portions, surfaces, and/or materials as will be described below with reference to FIGS. 5-11.

Figure 2:
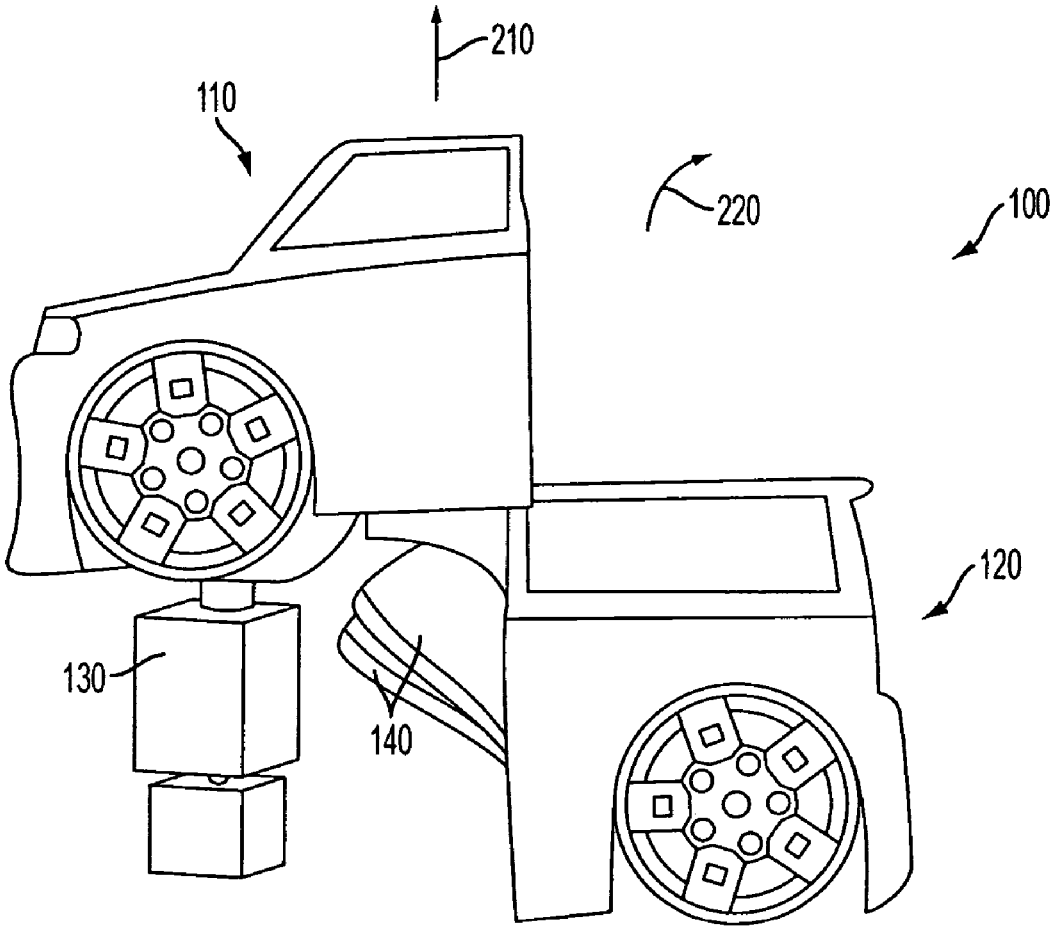
Figure 3:
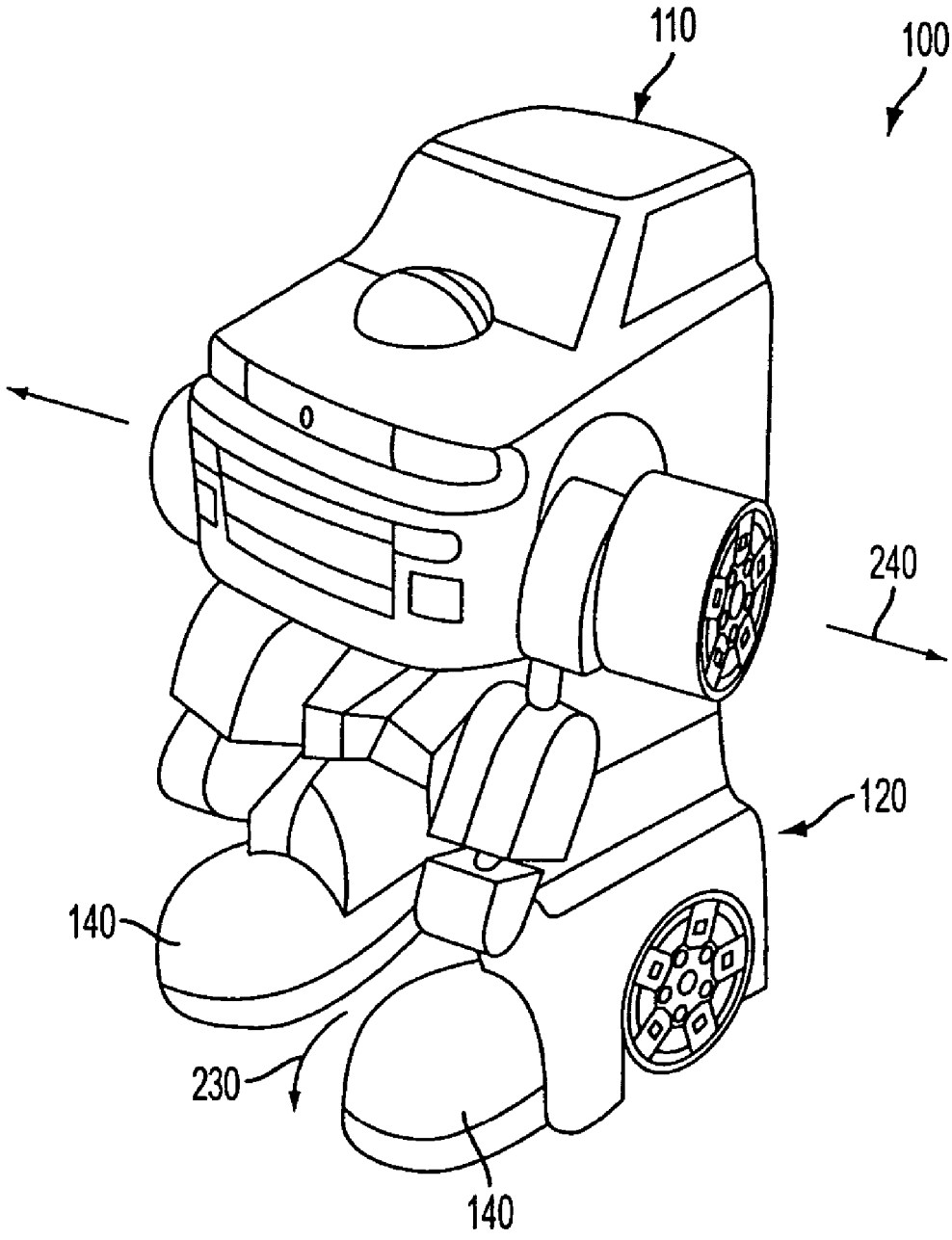
Figure 4:
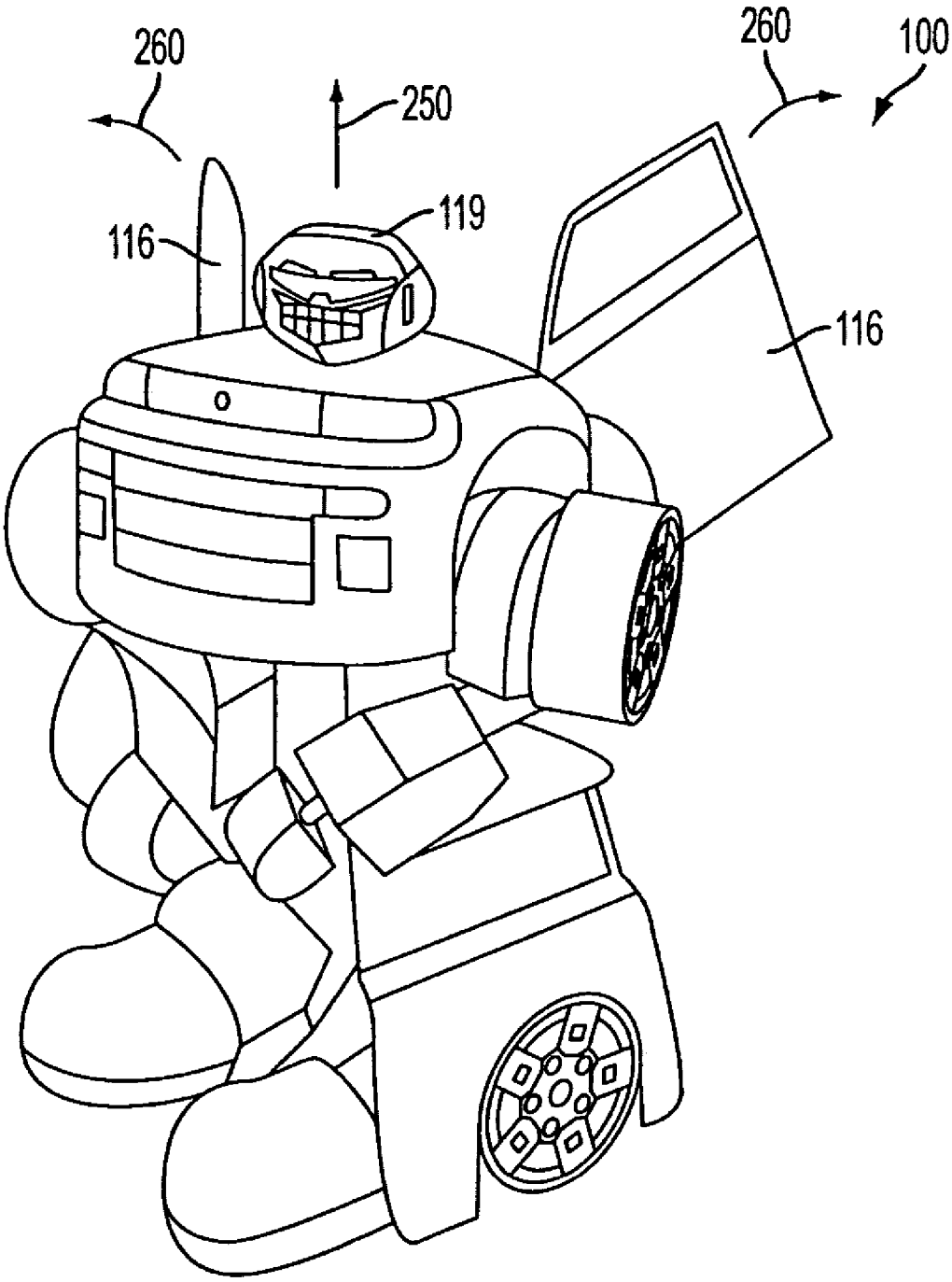
Figure 5:
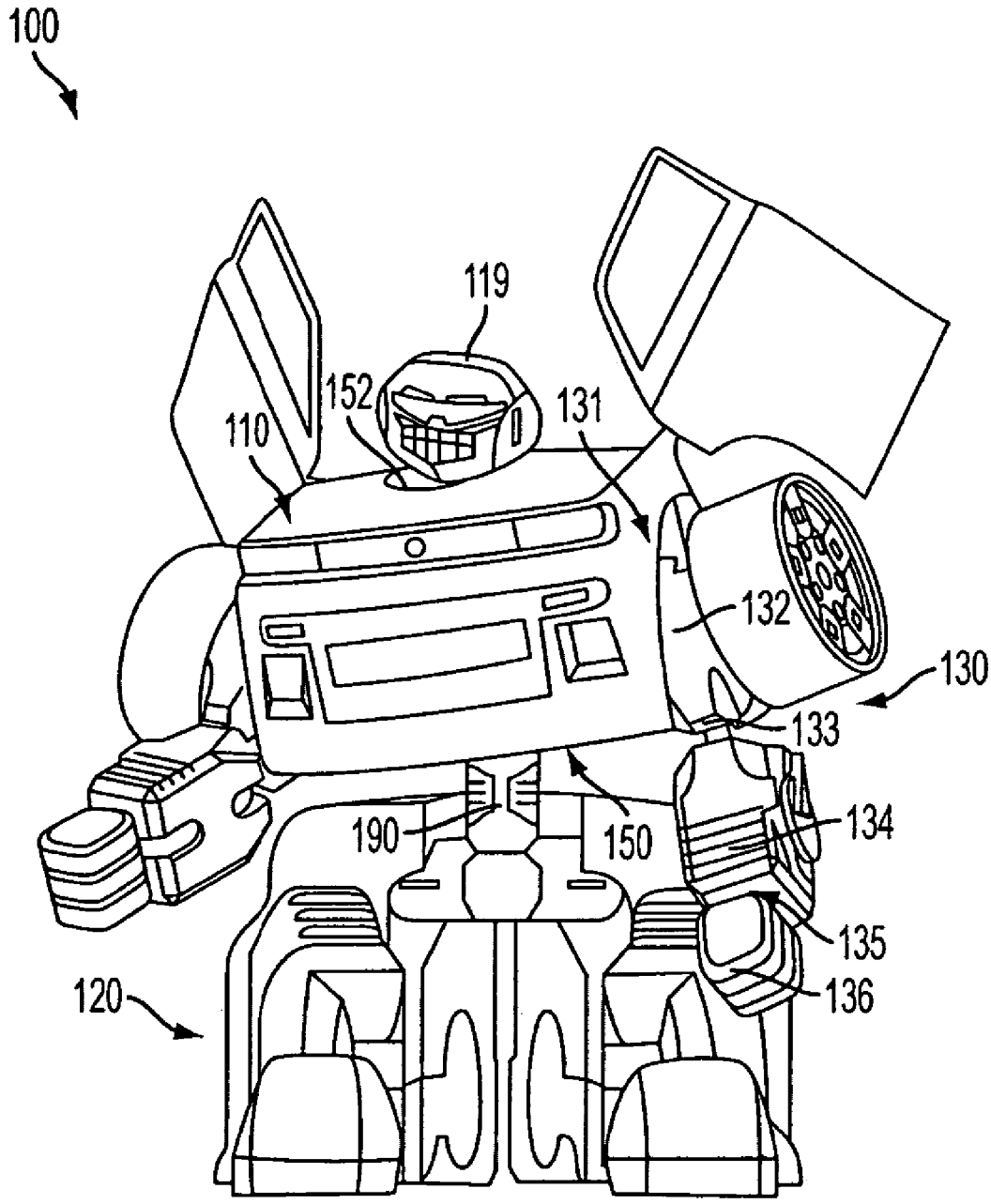

FIGS. 2 and 3 show how toy 100 can be transformed from the vehicle mode of FIG. 1 to the action figure mode of FIGS. 4 and 5. For example, FIG. 2 shows how front portion 110 can be translated upward relative to rear portion 120 as indicated by vector 210. The translation and/or rotation of front portion 110 are shown exposing a right and left pair of shoes 140 coupled to rear portion 120. Further, a right and left arms 130 can be translated and/or rotated downward from front portion 110. Next, the front portion can be moved from the position of FIG. 2 to the position of FIG. 3 by translating and/or rotating front portion 110 relative to rear portion 120 as indicated by vector 220.

Next, as shown in FIG. 3, the front end of shoes 140 can be rotated downward toward the ground surface as indicated by vectors 230. Arms 130 and front wheels 110 can be translated outward from front hood 114 as indicated by vectors 240. As shown in FIG. 3, the left front wheel can be coupled to the left arm and the right front wheel can be coupled to the right front arm. Next, as shown in FIG. 4, element 119 simulating an engine in the vehicle mode can be translated upward relative to front hood 114 as indicated by vector 250, thereby simulating a head in the action figure or robot mode. In this manner, a single element that simulates an engine in the vehicle mode can also simulate a head in the action figure mode. Further, front window portion 118 can be rotated downward, and left and right front doors 116 can be rotated relative to front hood 114. Toy 100 can be transformed back to the vehicle mode by reversing the transformation operation described herein with reference to FIGS. 1-4.

Referring now to FIG. 5, front portion 110 is shown moveably coupled to stem 190 of rear portion 120 by joint 150. Joint 150 can be configured to provide multiple degrees of freedom to enable front portion 110 to rotate in a plurality of directions relative to rear portion 120. In this manner, the upper body portion (front portion 110) of the action figure mode can be rotated relative to lower body portion (rear portion 120) about joint 150 to vary the positioning of toy 100. For example, joint 150 can be configured to enable rotation of upper portion 110 relative to lower portion 120 in a first plane that is substantially parallel with the ground surface as indicated by vector 260. Further, joint 150 can also enable forward, rearward, left, and right rotational motion of upper portion 110 relative to lower portion 120. In some embodiments, element 119 can be coupled to front hood 114 by a joint, which can enable rotation of element 119 relative to front hood 114 in one or more planes of rotations, thereby simulating a neck joint. In some embodiments, one or more of joints 150 and 152 can be ball joints. In this manner, toy 100 in an action figure mode can be posed in a variety of positions to simulate different actions, attitudes, emotions, and/or body configurations.

Similarly, the positioning of left and right arms 130 can be varied to simulate different actions and/or positions via one or more joints. For example, left and right arms 130 may each include upper arm 132, lower arm 134, and hand portion 136. Upper arm 134 may be moveably coupled to front portion 114 by joint 131, thereby simulating a shoulder joint. In some embodiments, joint 131 may share a common axis of rotation with front wheel 112. Lower arm 134 can be moveably coupled to upper arm 132 by joint 133, thereby simulating an elbow joint. Hand portion 136 can be moveably coupled to lower arm 134 by joint 135, thereby simulating a wrist joint. Joints 131, 133, and 135 may each be configured to provide rotation in one, two, or three orthogonal planes.

Further, various portions of toy 100 in the action figure mode can embody a particular theme such as street culture. For example, shoes 140 can simulate popular shoes and may contain officially licensed insignia, symbols and/or designs of real shoe manufacturers. Similarly, the head of toy 100 may include a hat, sunglasses and/or teeth simulating shiny metal, diamonds, and jewels.

In some embodiments, various regions of a toy such as toy 100 described herein can include thermochromic material that changes the appearance of the toy responsive to temperature. For example, toy 100 may include a variety of thermochromic regions covering some or the entire toy in one or both play modes. Thermochromic regions may be provided in some examples by an outer coating applied to the material such as by paint, or other coating, or may be inherent in the material forming the toy structure. Alternatively, stickers and/or decals having thermochromic properties may be used. In one example, at least a portion of a toy can include a thermochromic region such that at a first temperature the thermochromic region exhibits a first color or opacity, and at a second temperature different from the first temperature, the thermochromic region exhibits a different color or opacity. In some examples, a thermochromic region of a toy can have a layer that is substantially transparent at select temperatures, exposing the underlying surface color and/or design, while at other temperatures, the underlying color or design can be obscured by the thermochromic layer exhibiting a different color and/or opacity. It should be appreciated that the thermochromic surfaces described herein can be configured to vary in appearance (e.g. color and/or opacity) responsive to virtually any temperature condition. For example, a thermocromatic surface or material can be configured to change color and/or opacity when varied above or below a specific temperature (e.g. 25° C.) or temperature range. In another example, a thermochromic surface or material at an ambient room temperature of 20° C. can be configured to change color (e.g. green to red) and/or opacity (e.g. transparent to opaque) when subjected to a temperature less than 15° C. In yet another example, a thermochromic surface at an ambient room temperature of 20° C. can be configured to change color and/or opacity when subjected to a temperature greater than 30° C. In this manner, a thermochromic region may be hidden at room temperature and may reveal hidden designs, patterns and/or codes when contacted by water of a cooler and/or warmer temperature. However, it should be appreciated that other temperatures could be used to affect a change of appearance as these scenarios have been provided merely as examples.

While thermochromic regions may be provided by various surface treatments and/or material selection, some approaches may be better suited to a particular application. For example, stickers and/or decals may not be suitable for some toys where it is desirable to have a substantially smooth surface, where the thermochromic region is to be hidden from view or where the toys may be exposed to substances such as water that may damage the sticker and/or decal. Further, decals and/or stickers may be interrupted by discontinuities, boundaries, gaps, or joints of the toy, whereas surface treatments may be applied over an entire surface. The life span of stickers and/or decals may be reduced by exposure to some temperature conditions, humidity, and/or moisture. Thermochromic regions that are integrated with the body of the toy such as paints, coatings, and/or the material can provide a thermochromic response that is visually consistent even across a discontinuity, boundary, gap, or joint of the toy. For example, thermochromic paint could be on two separate and adjacent portions of a toy, wherein a temperature change causes a common visual appearance across the boundary of the adjacent portions. Thus, thermochromic surface treatments including various paints, coatings, and/or materials that are integrated with the toy may be better suited to applications where it is desirable to provide a substantially smooth surface treatment, water resistance, and/or hidden thermochromic regions. However, it should be appreciated that thermochromic stickers and/or decals may be used in some examples.

The temperature of the thermochromic regions of a toy may be adjusted in a variety ways. In one approach, the entire toy may be exposed to a select temperature condition causing all of the thermochromic regions of the toy to respond to the temperature variation. In another approach, only a portion of a thermochromic region may be exposed to a select temperature condition causing only the portion of the thermochromic region to respond to the temperature variation. In one example, a user may contact a thermochromic region of the toy with their hand or finger, potentially causing a temperature change of the contacted region due to a temperature variation between the user and the toy surface. In another example, a user may apply a liquid such as water to a thermochromic region of the toy potentially causing a temperature change of the region contacted by the water.

Figure 6:
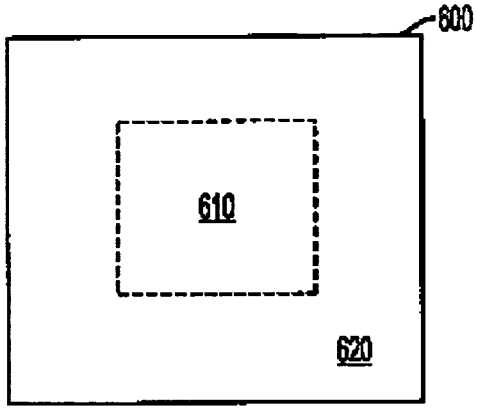
FIGS. 6-11 show example thermochromic regions for a toy product.
Figure 7:
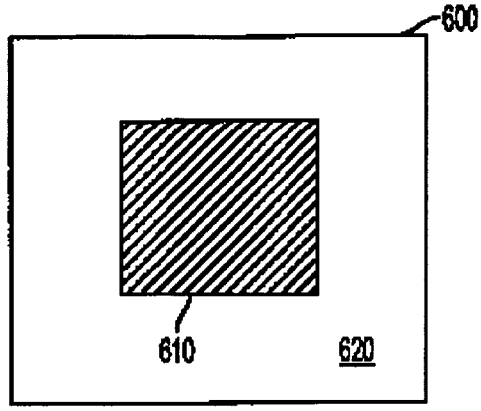

FIGS. 6 and 7 show an example surface 600 of a toy (e.g. toy 100) having a thermochromic region 610 surrounded by a region 620 not having thermochromic properties. FIG. 6 shows surface 600 at a first temperature and FIG. 7 shows surface 600 at a second temperature different than the first temperature causing thermochromic region 610 to change color and/or opacity. In one example, during a first temperature condition, thermochromic region 610 can exhibit a substantially similar color as region 620 and hence be hidden or obscured from view as indicated by the broken line in FIG. 6. At a different (e.g. lower) temperature, thermochromic region 610 can exhibit a different color and/or opacity as shown in FIG. 7 as a shaded region. In this manner, a toy such as transformable toy 100 can include one or more thermochromic regions that enable a particular change in appearance at select temperatures. For example, an arm portion of toy 100 such as lower arm 134 may include a first thermochromic region exhibiting a first color under a first temperature condition and a body portion of toy 100 such as element 119 simulating a head in the action figure mode can have a second thermochromic region exhibiting a second color under a second temperature condition that may be different or the same as the first temperature condition.

Figure 8:
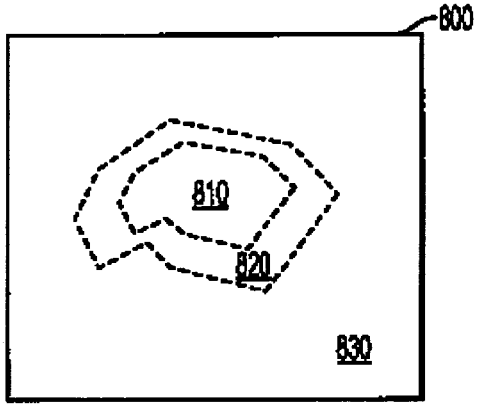
Figure 9:
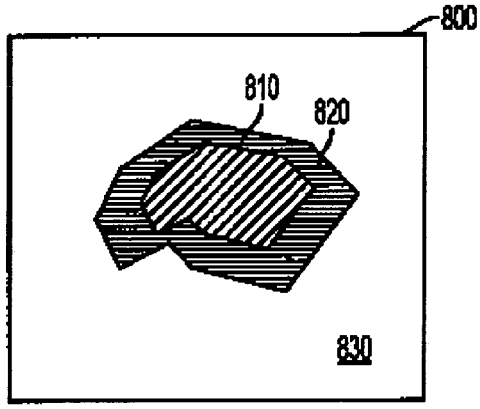
Figure 10:
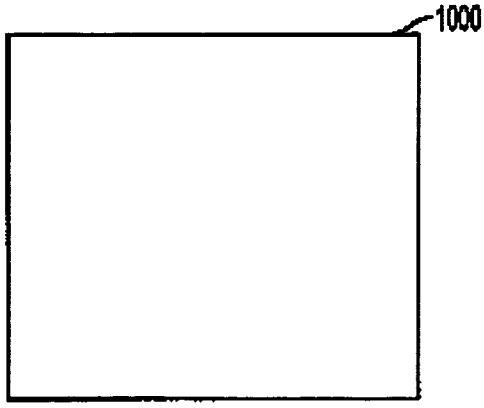
Figure 11:
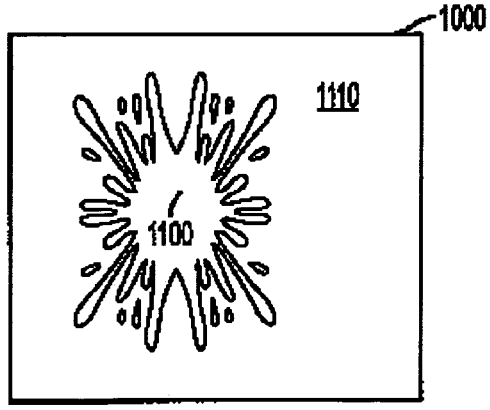

In some embodiments, a toy may have a plurality of thermochromic regions that are configured to respond the same or differently to various temperature conditions. FIGS. 8 and 9 show an example toy surface 800 having a plurality of different thermochromic regions 810 and 820 surrounded by a non-thermochromic region 830. FIG. 8 shows surface 800 at a first temperature, while FIG. 9 shows surface 800 at a second temperature different from the first temperature. At some temperatures, regions 810 and 820 can exhibit substantially the same behavior shown in FIG. 8 as shaded regions. For example, thermochromic regions 810 and 830 can both have a similar transparency for exposing an underlying color or design and/or they can both exhibit the same color, which can be the same or different than the color of region 830. As shown in FIG. 8, these thermochromic regions can be of irregular shape and be substantially hidden from view (i.e. transparent) at some temperature conditions such as, for example, at ambient room temperature. At higher or lower temperatures, thermochromic regions 810 and 820 can change color and/or opacity as show in FIG. 9. In this manner, the different thermochromic regions and/or boundaries defining regions 810 and 820 can be arranged to simulate a specific pattern, such as simulated blast damage caused to surface 800.

In some embodiments, the appearance of only a portion of a particular surface can be varied by a liquid such as water having a different temperature than the toy. As will be described in detail below with reference to FIGS. 12 and 13, various accessories may be provided that eject or dispense liquid. In this manner, a user may receive feedback regarding the accessory usage in the form of a visual indication of where the liquid has hit or contacted the toy. An example thermochromic surface 1000 is shown exhibiting a substantially homogeneous appearance in FIG. 10 and a portion thereof shown as region 1100 in FIG. 11 exhibiting a different appearance when contacted with a liquid having a different temperature than the thermochromic surface. As one example, water having a temperature that is higher than the temperature of the thermochromic surface 1100 can be dispensed or ejected onto surface 1000 indicated by region 1100 causing the region subjected to the warmer water to change color and/or opacity. Alternatively, thermochromic surface 1000 can be configured to respond to cooler temperatures such as water having a temperature that is less than a threshold temperature. In this manner, portions of a thermochromic surface such as surface 1000 can be varied by dispensing or ejecting water onto a portion of the surface such as region 1100, thereby varying the appearance of the toy.

Figure 12:
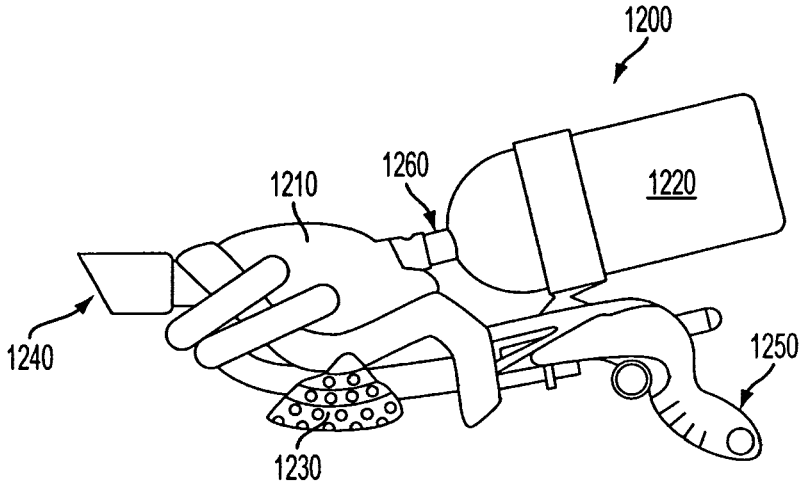
FIGS. 12 and 13 show example accessories that can be operated to eject a liquid.

In some embodiments, a liquid such as water may be dispensed or ejected by an accessory onto one or more thermochromic surfaces of a toy such as transformable toy 100. FIG. 12 shows an example accessory 1200 configured to eject water. As shown in FIG. 12, accessory 1200 may simulate a blaster that can be used by a user to mark various thermochromic regions of a toy. In this manner, a user may receive feedback on whether their shot was successful. Two or more users may compete and/or a user's shooting skill may be identified by comparing the number thermochromic changes and/or the amount of thermochromic change inflicted on various toys by a liquid ejected from the accessory.

Accessory 1200 may include a body 1210, an actuator 1230, a handle 1250, a nozzle 1240, and a cartridge 1220. Cartridge 1220 can be configured to store water or other liquid for use by accessory 1200. An end portion 1260 of cartridge 1220 can be coupled to body 1210 of the accessory so that water is able to flow from the cartridge to the accessory during use. A liquid may be ejected or dispensed from accessory 1200 via nozzle 1240 upon actuation of actuator 1230. In at least one embodiment, actuator 1230 may provide pumping action to the water within accessory 1200, thereby propelling the liquid outward from nozzle 1240. In another embodiment, a spring loaded mechanism within body 1210 can provide propulsive force of liquid from nozzle 1240 upon actuation of actuator 1230 by a user. In yet another embodiment, accessory may not include an actuator and instead cartridge 1220 may be squeezable and/or flexible enabling a user to squeeze cartridge 1220, thereby propelling the liquid from nozzle 1240.

In some embodiments, nozzle 1240 may be adjustable to enable a user to select a variety of spray patterns. These spray patterns in turn may be used to provide a varied thermochromic response by the target toy. For example, a narrow spray pattern may be selected by a user that ejects water onto a relatively small area of the thermochromic surface, but creates a substantially significant change (e.g. color and/or opacity) of appearance within the area. In another example, a larger spray pattern may be selected by a user that ejects water onto a relatively larger area of the thermochromic surface, but creates a less significant change of appearance within the area.

Figure 14:
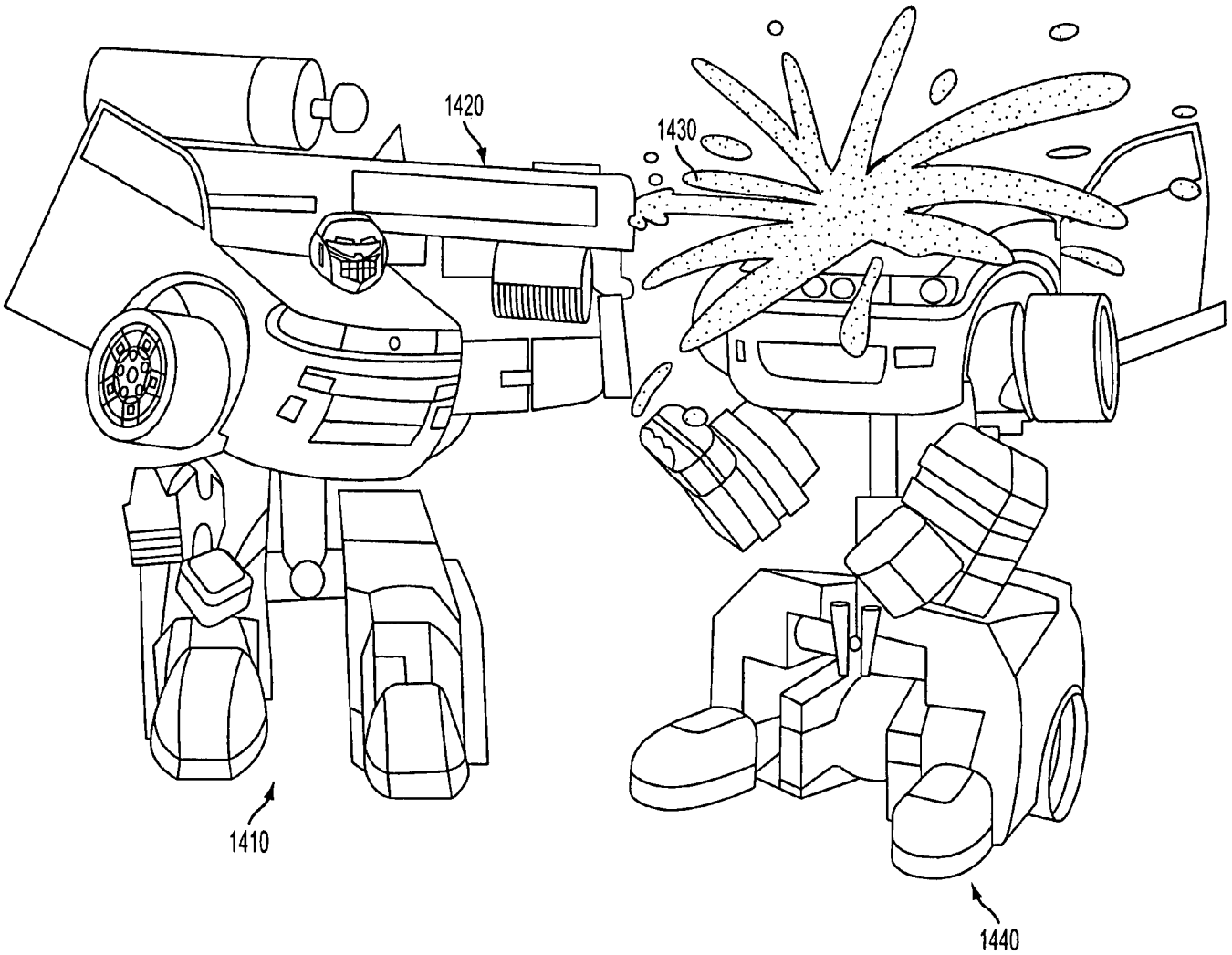
FIGS. 14 and 15 show example toy interactions.

Further, handle 1250 can be adapted to be grasped by a user and/or by a hand portion of a toy such as hand 136 described above with reference to FIG. 5. In this manner, accessory 1200 can be removably coupled to toy 100 in one or more of the vehicle and/or action figure modes via a press fit or snap fit. Accessory 1200 can be suitably sized to simulate a blaster that may be used by the transformable toy, for example as shown in FIG. 14, however accessory 1200 can be other sizes.

In some embodiments, cartridge 1220 can be coupled or uncoupled from body 1210, enabling the cartridge to be refilled with a liquid of selected temperature. The cartridge can be refilled with water that is cooler or warmer than the ambient conditions via an opening in end portion 1260. Cartridge 1220 can be transparent, translucent, and/or opaque, or combinations thereof. In some embodiments, cartridge 1220 or other portions of accessory 1200 may include thermochromic surfaces or materials that vary with temperature, thereby indicating to a user the relative temperature of the liquid within cartridge 1220. In this manner, a user may be able to differentiate whether a liquid within the cartridge and/or accessory is warmer than a threshold temperature, within a temperature range, or cooler than a threshold temperature. Thus, the appearance of the cartridge and/or accessory can indicate to a user when the liquid within the cartridge should be exchanged, heated, cooled, and/or refilled. Further, the thermochromic response provided by the cartridge to particular temperature conditions may be configured to correspond with the thermochromic response of one or more related toys, thereby providing a user with an indication of whether the liquid ejected or dispensed by the accessory would be effective in varying the appearance of the related toy when subjected to the dispensed or ejected liquid. In this manner, a user may be able to identify when the temperature of the liquid is within a temperature range that will affect the appearance of the related toys.

In one approach, cartridge 1220 may be filled with a liquid and placed in a refrigerated environment to provide liquid that is cooler than ambient. Further, thermochromic portions or surfaces of the cartridge and/or accessory can be used to indicate when the liquid is sufficiently heated or cooled. However, it should also be appreciated that cartridge 1220 may be refilled with a liquid such as water having temperatures commonly encountered with a household faucet (e.g. 15° C. to 30° C.).

In some embodiments, accessory 1200 may include a plurality of interchangeable cartridges as described above with reference to cartridge 1220. In this manner, a user may be able to quickly reload accessory 1200, without requiring the user to refill a cartridge. In some embodiments, some of the cartridges may be configured to provide thermochromic behavior that is different from other cartridges. A first cartridge may be configured to respond to a first range of temperature conditions and a second cartridge may be configured to respond to a second range of temperature conditions greater than the first range. For example, accessory 1200 may include at least a first cartridge configured to indicate cooler temperatures and a second cartridge configured to indicate warmer temperatures than the first cartridge. In this manner, a first cartridge can provide a liquid to accessory 1200 that causes a first change of appearance (e.g. color, opacity, etc.) to a related toy and a second cartridge can provide liquid having a different temperature to the accessory that causes a second change of appearance (e.g. color, opacity, etc.), thereby providing simulated healing of the toy. For example, a liquid of a first temperature may cause an indication, mark, or simulated damage to appear on a thermochromic region of a related toy and a liquid of a second temperature may cause the indication, mark, or simulated damage to disappear, thereby simulating healing of the thermochromic regions.

Figure 13:
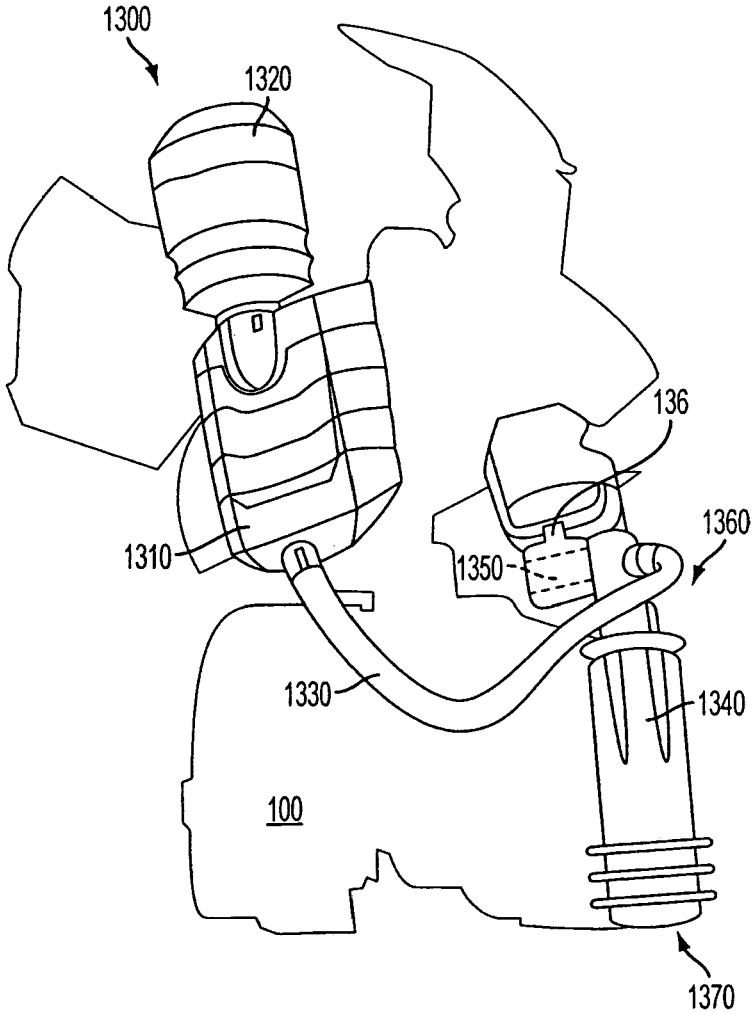

FIG. 13 shows another accessory 1300 that may be used to dispense or eject a liquid onto a thermochromic surface or material of a related toy. As shown in FIG. 13, toy 100 when in an action figure mode can simulate wearing the accessory. Accessory 1300 can include some or all of the features of accessory 1200, and can be configured to simulate a blaster that may be worn by or coupled to transformable toy 100 in one or both modes. Accessory 1300 may include, for example, a backpack 1310 for coupling the accessory to the toy in an action figure mode, a cartridge 1320 for storing a liquid, a line 1330 for transporting the liquid to other portions of the accessory, a nozzle body 1340, a handle 1350, an actuator 1360, and a nozzle 1370. Cartridge 1320 can include some or all of the features described above with reference to cartridge 1220 including, for example, thermochromic behavior. Cartridge 1320 can store and supply liquid to nozzle body 1340 via backpack 1310 and line 1330. Further nozzle body 1340 may be coupled to a hand portion of the transformable to simulate that the toy is controlling the accessory or other portion of the toy via a press fit, for example. Actuator 1360 can cause liquid to be ejected or dispensed from nozzle 1370 upon actuation. Ejection of liquid can be facilitated by pumping action provided by a user via actuator 1360 and/or a spring mechanism within nozzle body 1340. Alternatively, accessory 1300 may not include an actuator as liquid may instead be ejected via a user squeezing or flexing cartridge 1320. In some embodiments, nozzle 1370 may be adjustable to enable a user to select a variety of spray patterns.

It should be appreciated that other accessories may also be used. In one example, a toy such as toy 100 in a vehicle mode can be coupled to an accessory that simulates a vehicle body portion, wherein the accessory can also eject or dispense a liquid such as described herein with reference to accessories 1200 and 1300. Further, accessories that simulate vehicle body portions when coupled to a transformable toy in a vehicle mode can be configured to transform into a wearable accessory that may also be coupled to the transformable toy in another configuration, such as the action figure mode simulating, for example, a robot or other character. In yet another example, a toy may include a shield that can be used to block or deflect water that is ejected or dispensed from an accessory. For example, a shield may be coupled to a toy in an action figure mode, for example, at a hand portion. In some embodiments, a shield may be transformed to a vehicle body portion in the vehicle mode, such as a front hood, door, roof, or other portion of a vehicle. The shield may also include thermochromic regions as described above.

Figure 15:
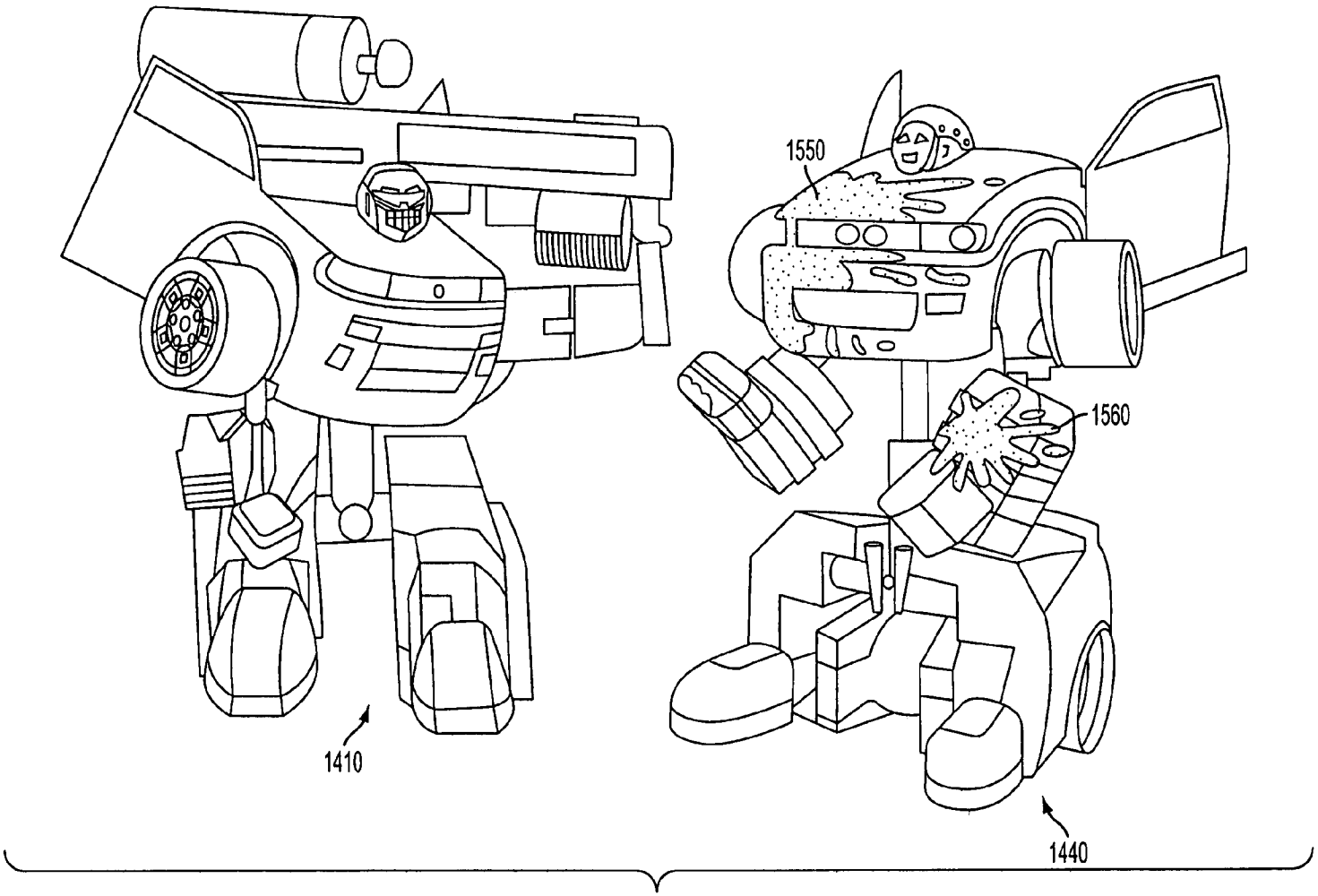

FIGS. 14 and 15 show an example interaction between a first toy simulating an action figure or robot having an accessory configured to eject a liquid such as water, and a second toy also simulating an action figure or robot. FIG. 14 shows how the first toy 1410 may be coupled to accessory 1420. It should be appreciated that toys 1410 and/or 1440 can include some or all of the features of transformable toy 100 described herein and that accessory 1420 can include some or all of the features of accessory 1200 or 1300, also described herein. Accessory 1420 is shown ejecting water 1430 onto a portion of toy 1440 causing thermochromic region 1450 to vary in color, thereby providing a visual indication or mark. For example, region 1450 can change color from blue to green where the water has contacted the toy; however other colors may be used. Further, the thermochromic regions may provide a different effects or appearances depending on the configuration or mode of the toy. While accessory 1420 is shown coupled to toy 1410, it should be appreciated that a user may use accessory 1420 to eject or dispense a liquid without requiring the accessory to be coupled to toy 1410.

Some toys may include a plurality of thermochromic regions having the same or different response to varying temperature conditions. For example, a toy configured as an action figure may include thermochromic regions having different color changing properties on the head, body, arms and/or legs, among other portions. Similarly, a toy configured to simulate a vehicle may have different thermochromic regions on the wheels, roof and/or the doors, for example. Further, transformable toys such as toy 100 may include thermochromic regions that are only accessible or exposed to a user during a particular configuration. For example, arms 130 of toy 100 may be inaccessible and/or hidden from view during the vehicle mode as shown in FIG. 1, while arms 130 may be more accessible and/or visible during the action figure mode of FIG. 7. In one approach, the thermochromic region may be non-exposed when the surface of the thermochromic region is in an internally facing configuration. The thermochromic region may be exposed when the surface of the thermochromic region is in an externally facing configuration. In some cases, a user may not be able to access or cause a thermochromic response to some portions of the toy during some play modes (e.g. vehicle and/or action figure modes), and/or a user may be able to reduce the visible thermochromic response (e.g. indication, markings, and/or simulated damage) by transforming the toy to another play configuration. In this manner, at least one play mode of a transformable toy may be a protection mode, wherein some thermochromic regions are not exposed.

Figure 16:
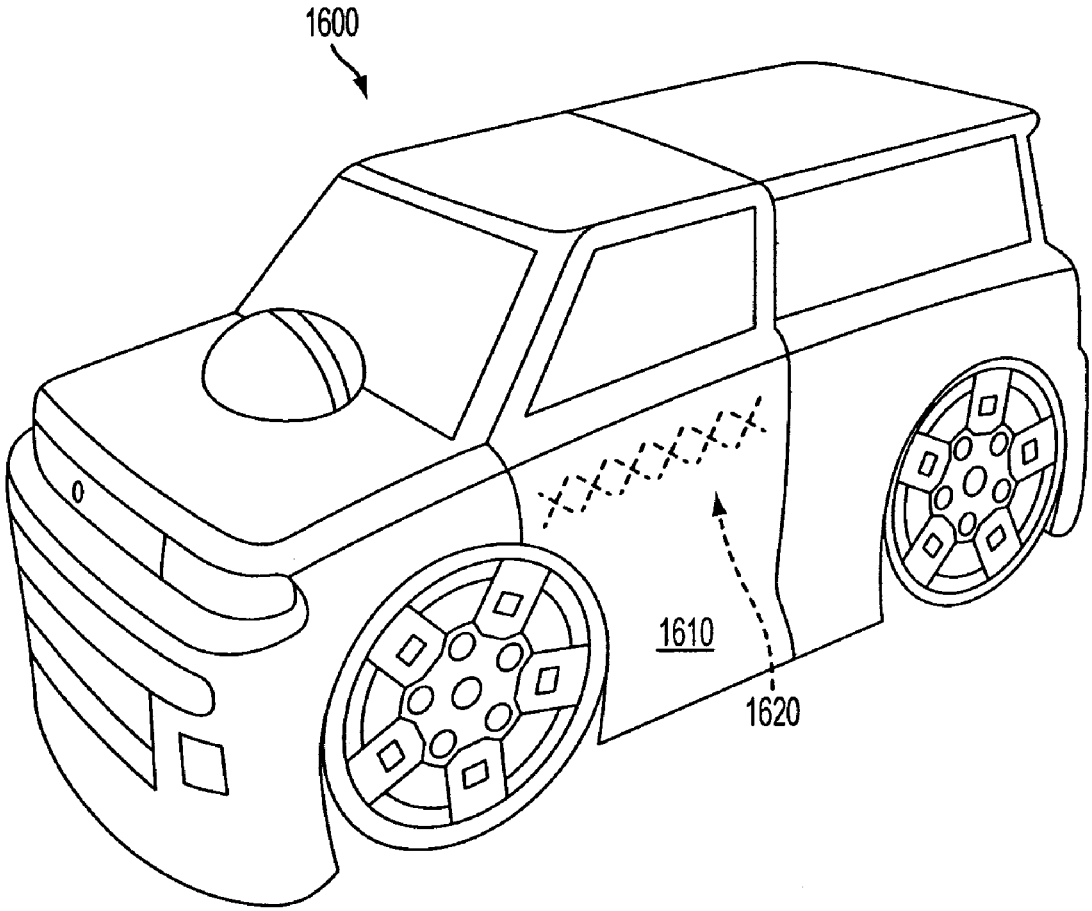
FIGS. 16 and 17 show an example toy having thermochromic codes.
Figure 17:
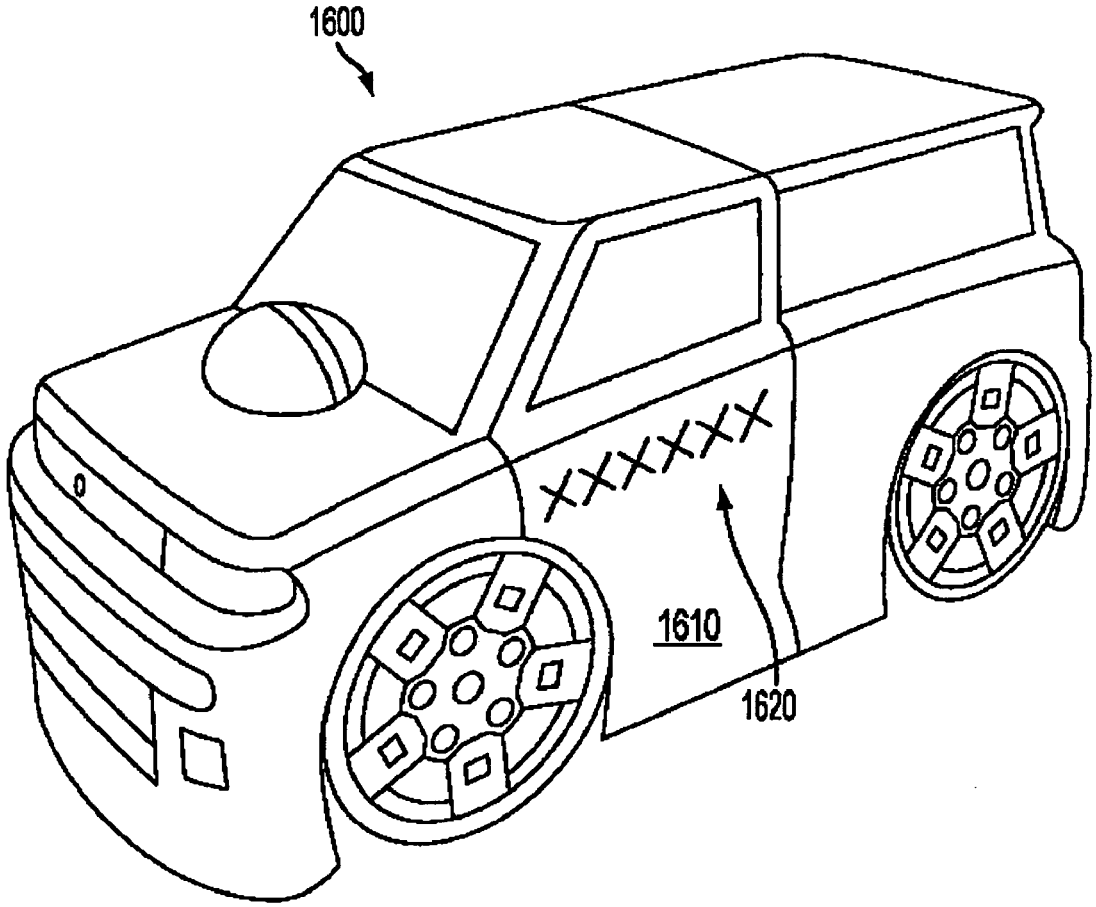

In some embodiments, a toy such as toy 100 described above may include one or more thermochromic regions that reveal a human readable code at select temperature conditions that may or may not be unique. FIGS. 16 and 17 show a toy 1600 having a surface 1610 a portion of which includes a plurality of thermochromic regions forming a thermochromic code 1620, shown herein by 6 Xs. Any suitable symbol, character, insignia, image or message may be used for code 1620. In one example, a six-digit code as shown in FIGS. 16 and 17 may be used having a first portion of three digits and a second portion of three digits. Although shown as having six digits, any number of digits may be used and be within the scope of the disclosure. Further, the code can include alphanumeric digits, in upper and/or lower case, binary numbers, as well as other symbols, such as, for example, <, >, /, +, –, ^, #, and/or | or fantastical, whimsical or imaginative symbols, pictures, images, etc. In one example, symbols found on keyboards may be used.

Thermochromic code 1620 (shown by broken lines in FIG. 16) can be configured to have substantially the same appearance as the surrounding non-thermochromic region of 1610 at some temperature conditions such as at room temperature, thereby hiding or obscuring from view thermochromic code 1620. At other temperature conditions, as shown in FIG. 17 the thermochromic code can have a different appearance such as a contrasting color with the color of the adjacent non-thermochromic region of 1610, enabling the code to be revealed. Alternatively, the code may be non-thermochromic and may be obscured by a thermochromic region. For example, the thermochromic region can define an outline of a code or codes. In some embodiments, the thermochromic codes or a code obscured by a thermochromic region may become visible or revealed at select temperature conditions such as by a water ejecting accessory, having a cooler or warmer temperature than the toy. Although shown as a single group of thermochromic regions, in some embodiments, a plurality of thermochromic codes may be distributed about various portions of the toy. For example, a toy simulating an action figure may have a first thermochromic code located on an appendage and a second thermochromic code located on another portion of the body. In at least one embodiment, the codes may be randomly distributed about the toy, thereby encouraging a user to search for the code. Further, different thermochromic codes can be configured to change appearance responsive to different temperature conditions. For example, a first code and a second code can be substantially hidden from view at a first temperature condition, wherein the first code may change color at a second temperature condition and the second code may change color at a third temperature condition different from the second temperature condition. As described herein, a different code may include one or more different elements of the code, or the number of elements of the code may be different.

Product based codes such as thermochromic code 1620 may be decoded by a user via a decoder. A decoder may be provided by a physical decoder book, an internet website configured to receive a code, and/or by an unrelated consumer product such as on or within a cereal box. In some examples, a code such as thermochromic code 1620 may be used to gain information about the toy and/or provide access to or be used with a game, an electronic game, a card game, a board game, a web-based or Internet game or site, a prize, a lottery, a DVD, a CD-ROM, etc. Thus, in some embodiments, a user may reproduce the code into an electronic interface device, such as a computer or gaming device. Reproduction of the code may result in a computer output based on the code or based on a plurality of codes.

A web based user interface or web site may be provided by a computer readable code or program located on a computer readable storage device. The computer readable code can be configured to provide instructions to a computer to generate web pages of a web site configured to receive the human readable code and provide an output in response to the user input. The output may include a link to another web page or web site providing additional information to the user.

In some embodiments, the computer output may include theme-based content which is dependent on the entered code or codes. For example, such codes may provide a user with access privileges to special sites, boards or levels, access to various powers or skill sets, access to previously unavailable information, access to new characters, access to historical or other factual information related to the toy from which the code was entered, etc.

In some embodiments, a code entered by a user may provide the user with secret or limited access information regarding the toy and/or other related toys. For toys such as dolls, the code may be decoded to reveal secret information about the toy or related toys such as the doll's dress size, friends, lifestyle, etc. In some embodiments, a code may be decoded by a user to provide information on how to use the toy (e.g. how to transform the toy), solve a problem with the toy, gain a next level in a related game, etc. A user may use the information provided by the decoder to determine, for example, the location of other hidden thermochromic regions and/or codes. In another example, the codes may be bonus content codes or game codes. The bonus codes may unlock bonus content, such as toy specific or item specific downloadable content or background information.

Thermochromic codes such as code 1620 can provide information to a user such as a point value for discovering or causing the code to appear. In one example, a first user may seek to discover various hidden codes on an opposing user's toy, for example, by ejecting water via an accessory such as described herein with reference to FIGS. 12 and 13. As a thermochromic code is revealed, the code may directly refer to a point value for discovering the code or striking a particular region of an opposing user's toy with the water. Alternatively, the codes may be used to determine a point value, for example, by entering the code into a web based site via a keyboard or by comparing the code to a book accompanying the toy to determine the point value.

In at least one example, a toy such as toy 100 described above may include a plurality of different thermochromic regions, wherein at least a first thermochromic region corresponds to a region of high point value or high importance such as the head/engine and/or the body, etc, while at least a second thermochromic region corresponds to a region of lower point value or lower importance, such as an appendage or wheel. Thus, a user that is successful at blasting the head/engine of the toy with water may be awarded more points or be provided with a more dramatic thermochromic response than a user that is successful in blasting an arm, leg, or wheel. Further, for some transformable toys, these thermochromic regions of higher point value or importance may be exposed only during some play modes. In this manner, a user may defend against an opponent's water blast by transforming the toy to a play mode providing limited exposure.

In some situations, a user may select a toy or a set of toys to obtain access to specific codes. A user may be desirous of obtaining the codes in order to access games, sites, powers, characters, etc. The codes may enhance the play experience for the user. Additionally, such codes may enhance the collectibility function of the toys. While FIG. 16 shows a thermochromic code applied to a toy vehicle, such a code may be applied to numerous products, such as toy dolls, action figures, scale vehicles, product packaging or combinations thereof. Moreover, codes may be promoted on movies, cartoons, websites, media releases, emails, packages, etc. As discussed above, such a code may enable access to various features through the Internet, computers, networked computers, DVD, games, etc. By applying or locating a human-readable code on a product such as a toy, various issues may be addressed. For example, the code may be less likely to be lost, or traded separately from the item, and additional packing requirements (that might otherwise be used to supply the code) may be reduced. Further, in the example where thermochromic regions are used to form the code on the item, a large variety of codes may be used, if desired.

Further, the code(s) and/or location of the code(s) may be different for each toy or product. In some embodiments, different thermochromic codes may be provided for each toy item or product and/or one or more thermochromic codes can be applied to different regions of each toy or product. In one example, a first toy may have a first code located on a first surface or region of the toy, and a second toy may have a second code different from the first code located on a second surface different from the first surface. In another example, a first toy may include only one code, while a second toy includes a plurality of codes. Further, toys may have code randomly disposed about various portions of the toy. Since a group of toys may include different codes and/or code locations, a user may be encouraged to interact with the toy or group of toys in order to locate and/or view each code. In at least one example, a user may be required to transform a toy such as toy 100 in order to discover or locate a code.

Figure 18:
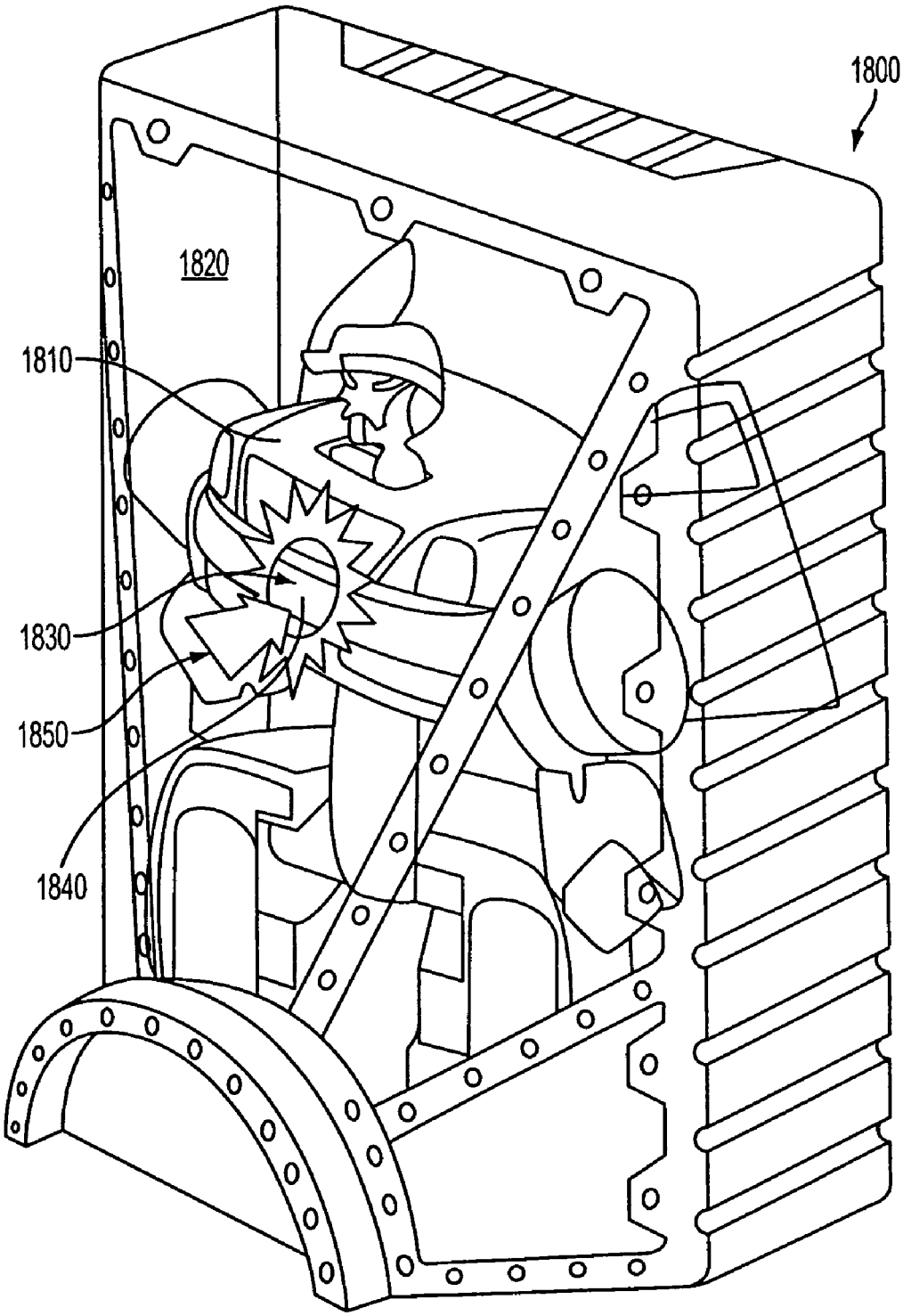
FIG. 18 shows example packaging for a toy having thermochromic capability.

Toys having various thermochromic regions can be packaged in a manner that enables a person to view the thermochromic behavior of the toy without opening the packaging. FIG. 18 shows example packaging 1800 for a toy 1810 having thermochromic capability such as toy 100 described herein. Packaging 1800 can include a transparent portion 1820 that enables a person to view the toy. Transparent portion 1820 can include an opening 1830 in the vicinity of a thermochromic region 1840 of the toy. Opening 1830 may be large enough to enable a person's finger or digit to pass through the opening and to make contact with thermochromic region 1840. Opening 1830 may also include an indicator 1850 that includes an arrow and/or text for directing a person to the intended purpose of the opening. For example, a person considering purchasing the toy may be motivated to contact the thermochromic surface of the toy via the opening to cause a resulting visual change to the toy, such as a color and/or opacity change caused by the temperature variation created by their finger. In this manner, a person may be able to observe the how the toy responds to temperature variations, thereby motivating the person to purchase the toy. While packaging 1800 is shown having a single opening 1830, it should be appreciated that the packaging may include a plurality of openings for enabling a person to access different thermochromic regions of the toy. Further, while opening 1830 is shown having a substantially circular shape, it should be appreciated that other shapes and/or size openings may be used.

Usage instructions may accompany the toy and/or toy packaging to enable a user to understand the various functions of the toy and/or related accessories. Usage instructions may include a detailed explanation of the transformation process, a code key for decoding various codes associated with the toy, codes that may be decoded via another source such as an internet webpage, a scoring procedure for evaluating the user's performance in blasting the toy with water, a map describing the various thermochromic regions and how they may be used, a description of other toys of a related set and their hidden codes and/or thermochromic regions.

As described herein, a toy may include one or more thermochromic regions that change the appearance of the toy in response to temperature. Further, these toys may be transformable between two or more different configurations or modes and may interact with associated accessories that simulate blasters and/or shields. The thermochromic regions may be arranged or configured to simulate damage caused by an accessory simulating a blaster that ejects a liquid such as water. In this manner, toy play may be improved by providing a variety of toy interactions such as the action/effect produced by the accessory ejecting a liquid onto a toy and the resulting thermochromic change performed by the toy, as well as the offensive/defensive play associated with the water ejecting accessory and shield combination.

It will be appreciated that the configurations and embodiments disclosed herein are exemplary in nature, and that these specific embodiments are not to be considered in a limiting sense, because numerous variations are possible. The components, shapes, colors, temperatures, etc. described herein are non-limiting examples and it should be understood that each of these features may be changed.

The subject matter of the present disclosure includes all novel and nonobvious combinations and subcombinations of the various systems and configurations, and other features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A product, comprising:

a reconfigurable toy assembly, said assembly being reversibly reconfigurable between at least a first configuration and a second configuration; and the toy assembly including at least one body surface with an integral thermochromic layer covering at least a portion of the body surface, where the integral thermochromic layer exhibits a visual change in response to temperature, and the body surface portion is internally facing in the first configuration and externally facing in the second configuration.

2. The product of claim 1 wherein the first configuration is a vehicle configuration and the second configuration is a figure configuration, said body surface being a vehicle body surface in the first configuration, the product further comprising instructions to a user, the instructions instructing the user apply a cool a medium to the toy assembly.

3. The product of claim 2 wherein the integral thermochromic layer is a common color with a non-thermochromic region of the toy assembly at a room temperature of approximately 20 degrees Celsius.

4. The product of claim 2 wherein the integral thermochromic layer is substantially planar with a non-thermochromic region of the toy assembly.

5. The product of claim 1 wherein the integral thermochromic layer comprises a coating on the body surface.

6. The product of claim 5 wherein the coating includes paint.

7. The product of claim 1 further comprising a blaster accessory including at least a cartridge, the cartridge configured to hold a liquid and having a squeezable section to pressurize and eject the liquid.

8. The product of claim 7, wherein the cartridge is removably coupled to the blaster accessory, and where the blaster accessory is shaped to be coupled to the toy assembly in at least one of the first and second configuration.

9. The product of claim 1 wherein the integral thermochromic layer reveals a human readable code.

10. The product of claim 9, wherein the thermochromic code may be input into an electronic interface device by a user to obtain information relating to the toy assembly.

11. The product of claim 10, wherein the electronic interface device is one of a computer or gaming device.

12. The product of claim 10, wherein the electronic interface device includes a computer program that is configured to receive the human readable code, the program producing an output based on the entered human readable code, the output including content relating to the entered human readable code.

13. The product of claim 12, wherein the content includes access privileges to at least one of a special site, a board, or a level.

14. The product of claim 12, wherein the content includes access to various powers or skill sets.

15. The product of claim 12, wherein the content includes access to previously unavailable information.

16. The product of claim 12, wherein the content includes access to historical or other factual information related to the toy assembly from which the human readable code was obtained.

17. The product of claim 12, wherein the content includes secret or limited access to information regarding the toy assembly.

18. The product of claim 12, wherein the output is related to the toy assembly having the human readable code.

19. The product of claim 12, wherein the output is a web page.

20. The product of claim 12, wherein the electronic interface device provides a website for entry of the human readable code, and the content includes access to a different web page within the website.

21. The product of claim 12, wherein the content includes access to various features through at least one of the Internet, a computer, a DVD, or a game.

22. The product of claim 9, wherein the human readable code is a bonus content code.

23. The product of claim 9, wherein the human readable code is a game code.

24. The product of claim 1, wherein the integral thermochromic layer is accessible to a user when the toy assembly is in its second configuration and inaccessible to the user when the toy assembly is in its first configuration.

25. The product of claim 24, wherein the reconfiguration of the toy assembly from its second configuration to its first configuration reduces the visual change of the integral thermochromic layer in response to temperature.

26. A product, comprising:

a reconfigurable toy assembly, said assembly being reversibly reconfigurable between at least a first configuration and a second configuration;

the toy assembly including at least one body surface with an integral thermochromic layer covering at least a portion of the body surface, and at room temperature, the integral thermochromic layer exhibits a visual appearance similar to another non-thermochromic layer adjacent the integral thermochromic layer so that the integral thermochromic layer is substantially hidden, where the integral thermochromic layer exhibits a visual change in response to a temperature below the room temperature, and the body surface portion is concealed in the first configuration and revealed in the second configuration;

a blaster accessory adapted to be removably coupled to the toy assembly; and a cartridge accessory adapted to be removably coupled to the blaster, the cartridge capable of retaining liquid.

27. The product of claim 26 wherein the temperature below room temperature is between approximately 10 and 20 degrees Celsius, and where room temperature is approximately 20 degrees Celsius.

28. The product of claim 26, wherein the cartridge includes a flexible bulb, where upon squeezing of the bulb liquid is pressurized and ejected from the blaster.

29. The product of claim 28 wherein the blaster includes an adjustable nozzle that varies a spray pattern of ejected liquid.

30. The product of claim 29 wherein the integral thermochromic layer reveals a human readable code.

31. The product of claim 26, wherein the visual change in response to a temperature below the room temperature is less when the toy assembly is in its first configuration than when the toy assembly is in its second configuration.

32. A product, comprising:

a reconfigurable toy assembly, said assembly being reversibly reconfigurable between at least a first configuration and a second configuration; and the toy assembly including at least one body surface with a thermochromic region on at least a portion of the body surface, where the thermochromic region exhibits a visual change in response to temperature, wherein at least some of the thermochromic region is internally facing in the first configuration and externally facing in the second configuration.

33. The product of claim 32 wherein the first configuration is a vehicle configuration and the second configuration is a figure configuration, where the thermochromic region is a paint layer, and where the thermochromic region is shaped to reveal a human readable code.

34. The product of claim 32, wherein an amount of the visual change is affected by whether the toy assembly is in its first configuration or in its second configuration.

35. The product of claim 34, wherein reconfiguring the toy assembly between its second configuration and its first configuration changes the visual change in response to temperature.

36. The product of claim 32, wherein the thermochromic region includes a human readable code that is exhibited in response to temperature, the portion of the at least one body surface with the human readable code is internally facing in the first configuration and externally facing in the second configuration.

37. The product of claim 32, wherein the visual change includes a thermochromic code, and a user may input the thermochromic code into an electronic interface device to obtain information relating to the toy assembly.

38. The product of claim 37, wherein the electronic interface device is one of a computer or gaming device.

39. The product of claim 37, wherein the electronic interface device includes a computer program that is configured to receive the human readable code, the program producing an output based on the entered human readable code, the output including content relating to the entered human readable code.

40. A reconfigurable product, comprising:

a body that is repositionable between a first configuration and a second configuration, the body having a plurality of surfaces that are hidden when the body is in its first configuration and that are visible when the body is in its second configuration, the body including a thermochromic region that exhibits a visual change in a response to temperature, the visual change including a human readable code that can be used by a user to obtain information relating to the product, the thermochromic region is located on one of the surfaces that is hidden when the body is in its first configuration and that is visible when the body is in its second configuration.

41. The product of claim 40, wherein the human readable code is accessible to a user when the body is in the first configuration and inaccessible to the user when the body is in the second configuration.

42. The product of claim 40, wherein the human readable code is one of a code that is obscured by the thermochromic region until the visual change occurs or a thermochromic code.

43. The product of claim 42, wherein the human readable code can be input by a user into an electronic interface device to obtain the information relating to the product.

44. The product of claim 43, wherein the electronic interface device is one of a computer or gaming device.

45. The product of claim 40, wherein the human readable code can be entered into a website to obtain the information.

46. The product of claim 45, wherein the information relating to the product includes historical or factual information relating to the product, and the website provides access to the historical or factual additional information.

* * * * *